United States Patent [19]

Maatman et al.

[11] Patent Number: 4,835,223

[45] Date of Patent: May 30, 1989

[54] FIBRES AND YARNS FROM A BLEND OF AROMATIC POLYAMIDES

[75] Inventors: Hendrik Maatman, Arnhem; Bernardus M. Koenders, Westervoort, both of Netherlands

[73] Assignee: Akzo N.V., Arnhem, Netherlands

[21] Appl. No.: 242,822

[22] Filed: Sep. 12, 1988

[30] Foreign Application Priority Data

Nov. 2, 1987 [NL] Netherlands ..... 8702601

[51] Int. Cl.[4] ..... C08L 77/00; A01D 34/08

[52] U.S. Cl. ..... 525/432; 428/359; 428/395; 57/243

[58] Field of Search ..... 525/432; 428/359, 395; 57/243

[56] References Cited

U.S. PATENT DOCUMENTS

| | | | |
|---|---|---|---|
| 4,120,914 | 10/1978 | Behnke et al. | 525/432 |
| 4,198,494 | 4/1980 | Burckel | 525/432 |
| 4,721,755 | 1/1988 | Maatman | 525/432 |

*Primary Examiner*—Lewis T. Jacobs
*Assistant Examiner*—A. Carrillo
*Attorney, Agent, or Firm*—Oliff & Berridge

[57] ABSTRACT

Fibres consisting wholly or substantially of a mixture of poly-p-phenylene terephthalamide and an aromatic copolyamide. They display an improved tensile strength and elongation at break if the mixture contains, as the copolyamide, (2–25% b.w. of) a polycondensation product of terephthalic acid, p-phenylene diamine and a monomer selected from the group consisting of piperazine, benzidine and 1,4-diamino anthraquinone. The fibres are particularly suitable for use in the manufacture of tire yarn.

4 Claims, No Drawings

FIBRES AND YARNS FROM A BLEND OF AROMATIC POLYAMIDES

The invention relates to fibres which are entirely or substantially formed from a polymer blend of poly-p-phenylene terephthalamide (PPDT) and some other aromatic polyamide. The invention also relates to yarns, more particularly tyre yarn, entirely or in part composed of such fibres.

Fibres from aromatic polyamides are well known and are preferably obtained by wet spinning a solution in concentrated sulphuric acid through an air gap, as described in U.S. Pat. No. 3,414,645. Since then it is particularly the fibres from PPDT which have become of industrial importance. These fibres are suitable for industrial uses because of their special properties, including more particularly their high thermal stability and their high tenacity and modulus.

Although fibres from other aromatic polyamides or copolyamides in principle have similar properties, they have up to now been of little or no technical significance besides those prepared from PPDT. This is all the more true of blends of aromatic polyamides. In the examples XV–XVII given in NL-A-No. 6 908 984 incidental mention is made of a blend of PPDT and poly-p-benzamide. This blend apparently offers no special advantages. GB-A-No. 2 160 878 describes fibres prepared from a mixture of PPDT and an aromatic-aliphatic copolyamide. The aliphatic component in the copolyamide serves to restrain fibrillation of the wholly aromatic fibres. JP-A-No. 57/115452 describes high-tenacity fibres obtained by melt spinning polyamide blends. In a process used to this end a small proportion of a wholly aromatic polyamide, such as PPDT, is blended with a melt processable polyamide having a relatively low melting.

Particularly for technical uses where dynamic loading plays an important role, as in automobile tyres, driving belts, cables and ropes, the mechanical behaviour of aromatic polyamide fibres is not always found adequate. There is a special need for fibres which, while having the same or a relatively high elongation at rupture, display a higher tenacity and may yet be obtained by the usual as-spun spinning method, i.e. without need for a special aftertreatment other than washing and drying.

There has now been found a blend of aromatic polyamides which can be processed into fibres possessing the improved properties referrred to above.

According to the invention this mixture is characterized in that in addition to PPDT it compriss a copolyamide derived from terephthalic acid, p-phenylene diamine and a third monomer selected from the group of piperazine, benzidine and 1,4-diaminoanthraquinone. This copolyamide is normally prepared from the monomers as a radnom copolymer, but it also may be so prepared that a block copolymer is obtained.

It has been found that the use of this copolyamide mixed with PPDT results in obtaining fibres which, depending on the spinning conditions, display a higher tenacity and/or elongation at rupture than fibres prepared in a similar way from the homopolyamide PPDT. This has probably to do with the presence even in small proportions of the deviating structural units in the polymer chain originating from the third monomer.

For practical purposes it is desirable that the copolyamide to be blended with PPDT contains at least about 2 mole % of deviating structural units, based on the total amount of diamine units, and at least 0,5% by weight of the copolyamide is present in the blend.

For industrial purposes it is in fact desirable for the blend to contain not more than 50% by weight of the copolyamide. After all, considering that the copolyamide is to be prepared separately, it is even preferred that it should be incorporated in the mixture in a subordinate amount. In view of the desired effect it is therefore recommended that use should be made of an amount of 2 to 25% by weight, based on the mixture. Particularly preferred is a copolyamide which in itself contains 2 to 10 mole % units of the third monomer and forms 2 to 10% by weight of the blend.

The polyamide components of the blend according to the invention may be prepared in the usual manner. A suitable method of preparing PPDT, consists, for instance, in polymerization of p-phenylene diamine and terephthaloyl dichloride in a solvent, the copolyamide being obtained by polymerization of terephthaloyl dichloride, p-phenylene diamine and one of the monomers piperazine, benzidine or 1,4-diaminoanthraquinone in a solvent. The polymers must have a viscosity which is sufficiently high for fibre purposes. Consequently, in general the polymers need have an inherent viscosity of at least 2,5, preferably higher than 4,0, and more particularly higher than 4,5. A suitable method particularly for preparing PPDT is described in U.S. Pat. No. 4,308,374.

By inherent viscosity is to be understood here the value calculated in accordance with $\eta_{inh} = \ln\theta_{rel}/0{,}5$, wherein $\eta_{rel}$ is the relative viscosity measured with a capillary viscometer at 25° C. of a solution of 0,5 g of polyamide in 100 ml of 96%-sulphuric acid.

The procedure for spinning fibres from solutions of aromatic polyamides in concentrated sulphuric acid is generally known and need not be further described. A suitable method particularly for processing PPDT is described, among other places, in U.S. Pat. No. 4,320,081.

The term fibres as used herein refers to all current types of fibres, irrespective of their length, ranging from staple fibres to endless filaments. As regards the properties of these fibres, it is especially the yarn made therefrom, more particularly tyre yarns, that are considered to be of practical importance. The invention will be exemplified below.

EXAMPLE a. Preparation of PPDT

Use being made of the procedure in Example VI of U.S. Pat. No. 4,308,374, but on a larger scale, PPDT was prepared in a mixture of N-methyl pyrrolidone and calcium chloride, the latter in a proportion of 9,5% by weight, calculated on the total reaction mass.

The ratio of the monomers p-phenylene diamine and terephthaloyl dichloride was 0,997 and the total monomer concentration was 13% by weight, also calculated on the total reaction mass. Following neutralization, washing and drying a polymer was obtained having an inherent viscosity of 5,5.

b. Preparation of copolyamide

Use being made of the same procedures, copolymers were prepared containing 5 mole % of the desired third polymer.

The preparation was carried out in a 1—l liter reactor in a medium of 470 g of N-methyl pyrrolidone and 55 g of calcium chloride. The monomer concentration was again about 13% by weight and in each series of runs use was made of 25,99 g of p-phenylene diamine, 51,42 g of terephthaloyl dichloride and the required amount of the third monomer, viz. 2,86 g of 1,4-diaminoanthraquinone, 2,08 g of benzidine and 1,03 g of piperazine.

Obtained were copolyamides having an inherent viscosity of 3,3; 4,8; and 3,0. respectively.

c. Preparation of spinning solution

As solvent there was used concentrated sulphuric acid having a strength of 99,8%. The solutions were prepared via mixing of in all 495 g of polymer with 2005 g of solid, cooled sulphuric acid, as described in Example III of U.S. Pat. No. 4,320,081.

d. Spinning procedure

The polymer solutions having a polymer content of about 19,8% by weight were spun by the air gap method, substantially as described in Example III of U.S. Pat. No. 4,320,081, use being made of a spinneret with 50 spinning orifices measuring 75 μm in diameter. The process was carried out at a spinning temperature of approximately 80° C., a coagulation bath temperature of 14° C. and a winding speed of 180 m/min.

The filaments were passed into the coagulation bath through a ring with a 12 mm opening and subsequently over a ceramic pin. The resulting filaments were wound up while under tension or not and thoroughly washed, neutralized, re-washed and dried.

e. Filament tensile tests

The load-elongation data were collected in comfority with ASTM-D 2101 by conducting tensile tests on individual filaments using an Instron tensile tester. The nominal gauge length was 0,10 m and the rate of extension 0,01 m/min.

The filaments had previously been conditioned at 20° C. and a relative humidity of 65%. For each type of yarn the average result of 10 filament tensile tests was calculated.

The test results obtained with the various polymer blends are summarized in the table below.

This table contains the results of experiments carried out under the same conditions as used for filaments made from the hompolyamide PPDT.

The tension in cN/dtex indicates the tension applied to the filaments in the wet state and prior to their being wound up. The modulus is the measured ASTM-D885 modulus in giga pascal.

The table clearly shows that as compared with the homopolyamide PPDT the use of the polymer blends according to the invention results in obtaining a higher tenacity and a higher elongation at rupture.

TABLE

| Polymer material | Run | Titre dTex | Tension cN/dTex | Modulus gPa | Tenacity cN/Tex | Elong. at rupture % |
|---|---|---|---|---|---|---|
| PPDT | 1 | 2,30 | 0 | 55 | 205 | 3,7 |
| | 2 | 2,24 | 0,2 | 68 | 216 | 3,6 |
| | 3 | 2,33 | 0,4 | 66 | 209 | 3,5 |
| | 4 | 2,29 | 0,8 | 70 | 216 | 3,5 |
| | 5 | 2,32 | 1,6 | 80 | 220 | 3,4 |
| | 6 | 2,30 | 3,0 | 113 | 215 | 2,8 |
| blend of PPDT + 5% by wt. of copolyamide with 5 mole % of 1,4-diaminoanthraquinone | 7 | 2,30 | 0 | 47 | 232 | 4,5 |
| | 8 | 2,25 | 0,2 | 53 | 233 | 4,3 |
| | 9 | 2,28 | 0,4 | 62 | 229 | 4,1 |
| | 10 | 2,30 | 0,8 | 67 | 226 | 3,9 |
| | 11 | 2,19 | 1,6 | 80 | 231 | 3,7 |
| | 12 | 1,90 | 3,0 | 117 | 238 | 3,1 |
| blend of PPDT + 5% by wt. of copolyamide with 5 mole % of piperazine | 13 | 2,15 | 0 | 49 | 228 | 4,3 |
| | 14 | 2,33 | 0,2 | 58 | 223 | 4,0 |
| | 15 | 2,38 | 0,4 | 58 | 217 | 3,9 |
| | 16 | 2,31 | 0,8 | 66 | 227 | 3,9 |
| | 17 | 2,28 | 1,6 | 85 | 228 | 3,5 |
| | 18 | 2,19 | 3,0 | 119 | 236 | 3,0 |
| blend of PPDT + 5% by wt. of copolyamide with 5 mole % of benzidine | 19 | 2,10 | 0 | 53 | 236 | 4,4 |
| | 20 | 2,13 | 0,2 | 56 | 227 | 4,2 |
| | 21 | 2,13 | 0,4 | 57 | 232 | 4,2 |
| | 22 | 2,15 | 0,8 | 62 | 227 | 4,0 |
| | 23 | 2,16 | 1,6 | 106 | 243 | 3,3 |
| | 24 | 2,02 | 3,0 | 123 | 240 | 2,9 |

We claim:

1. Fibres which are entirely or substantially formed from a polymer blend of poly-p-phenylene terephthalamide (PPDT) and some other aromatic polyamide, characterized in that said other polyamide is a copolyamide derived from terephthalic acid, p-phenylene diamine and a third monomer selected from the group of piperazine, benzidine and 1,4-diaminoanthraquinone.

2. Fibres according to claim 1, characterized in that the blend contains 2 to 25% by weight of the copolyamide.

3. Fibres according to claim 2, characterized in that the blend contains 2 to 10% by weight of the copolyamide and this copolyamide contains 2 to 10 mole % of units of the third monomer, based on the total amount of the diamine units.

4. Yarns which are entirely or in part composed of fibres according to claim 1.

* * * * *

UNITED STATES PATENT AND TRADEMARK OFFICE

CERTIFICATE OF CORRECTION

PATENT NO. : 4,835,223

DATED : May 30, 1989

INVENTOR(S) : H. MAATMAN; B. KOENDERS

It is certified that error appears in the above-identified patent and that said Letters Patent is hereby corrected as shown below:

Column 1, line 37, after "melting" insert --point--;

line 52, change "compriss" to --comprises--.

Column 2, line 31, change "$\eta_{inh}$ = ln $\theta_{rel}$/0,5," to --$\eta_{inh}$ = ln $\eta_{rel}$/0,5,--;

line 66, change "1-1 liter" to --1-l--.

Column 3, line 57, change "comfority" to --conformity--.

Signed and Sealed this

Thirteenth Day of February, 1990

*Attest:*

JEFFREY M. SAMUELS

*Attesting Officer*

*Acting Commissioner of Patents and Trademarks*

UNITED STATES PATENT AND TRADEMARK OFFICE

CERTIFICATE OF CORRECTION

PATENT NO. : 4,835,223

DATED : May 30, 1989

INVENTOR(S) : H. MAATMAN; B. KOENDERS

It is certified that error appears in the above-identified patent and that said Letters Patent is hereby corrected as shown below:

Column 1, line 57, change "radnom" to --random--.

Column 4, line 9, change "hompolyamide" to --homopolyamide--.

Signed and Sealed this

Twelfth Day of November, 1991

*Attest:*

HARRY F. MANBECK, JR.

*Attesting Officer*

*Commissioner of Patents and Trademarks*